United States Patent [19]

Harm

[11] 4,294,474

[45] Oct. 13, 1981

[54] PREFABRICATED CHIMNEY-SHAFT

[76] Inventor: Josephus J. D. Harm, Vijzelgracht 29-31, Amsterdam, Netherlands

[21] Appl. No.: 945,234

[22] Filed: Sep. 25, 1978

[51] Int. Cl.[3] ..... F16L 39/00

[52] U.S. Cl. ..... 285/133 R; 285/424; 285/183

[58] Field of Search ..... 285/133 R, 138, 424, 285/183; 90/60; 130/114

[56] References Cited

U.S. PATENT DOCUMENTS

| | | | |
|---|---|---|---|
| 601,542 | 3/1898 | Barnes | 285/133 R |
| 2,091,608 | 8/1937 | Ostendorf | 285/133 R |
| 2,851,288 | 9/1958 | Kinkead | 285/133 R |
| 3,226,135 | 12/1965 | Epstein | 285/133 R X |
| 3,872,780 | 3/1975 | Zonias | 285/133 R X |

*Primary Examiner*—Arola Dave W.

*Attorney, Agent, or Firm*—Silverman, Cass & Singer, Ltd.

[57] ABSTRACT

A prefabricated chimney-shaft constructed from an outer sheath surrounding an inner sheath, in which the end portions of the inner and the outer sheaths are interconnected by perpendicularly positioned tie members having bent-over rims joining the sheaths, such that at one end the rims project a longitudinal distance out of the outer sheath, and at the other end the tie member and rims are recessed a longitudinal distance from the end of the outer sheath.

5 Claims, 5 Drawing Figures

PREFABRICATED CHIMNEY-SHAFT

The invention relates to a prefabricated chimney-shaft comprising an inner sheath and an outer sheath surrounding said inner sheath, in which the inner sheath and the outer sheath are interconnected near their ends with the aid of tie members.

Known prefabricated chimney-shafts of the kind set forth have inner sheaths and outer sheaths both of cylindrical shape, whilst the tie members are formed by annular parts of U-shaped cross-section, which are manufactured by deep drawing from a piece of sheet material. The successive parts are fastened to one another by means of tags punched from the tie members and the joining parts have to be relatively turned through a given angle in order to cause the tags of the various parts to grip one beneath the other.

Particularly the manufacture of the tie members requires expensive tools, which results in a considerable increase in cost price. A further difficulty involved in this known construction resides in the interposition of insulating material between the inner sheath and the outer sheath. In general only granular insulating material can be employed for this purpose, but this requires additional steps for preventing the insulating material from flowing out through the apertures machined in the tie members.

Moreover, the bends used in this known construction have a complicated structure and can be manufactured only with difficulty, whilst the passage through an inclined roof requires a complicated and expensive structure for sealing the opening made in the roof.

With such a circular chimney-shaft it is generally desirable to arrange a rectangular case around the chimney-shaft for improving the appearance and for preventing the formation of dust pockets and the like around the circular shaft.

According to the invention at least the outer sheath has a multi-angled, preferably rectangular cross-section.

The use of such a shape of the outer sheath permits of forming such a tie member that its manufacture is particularly simple, whilst in addition the interconnection of the successive parts can be established in a simple manner. Moreover, the application of insulating material is simplified, since, if desired, blankets of insulating material wrapped around the inner sheath may be employed. With such an embodiment the bends too can be manufactured in a simpler manner, whilst in addition sealing of the passage through a roof can be more readily carried out. Moreover additional panelling around the chimney-shaft may, in general, be dispensed with.

The invention will now be described more fully with reference to an embodiment of the construction in accordance with the invention, schematically illustrated in the accompanying figures.

Figure 1:
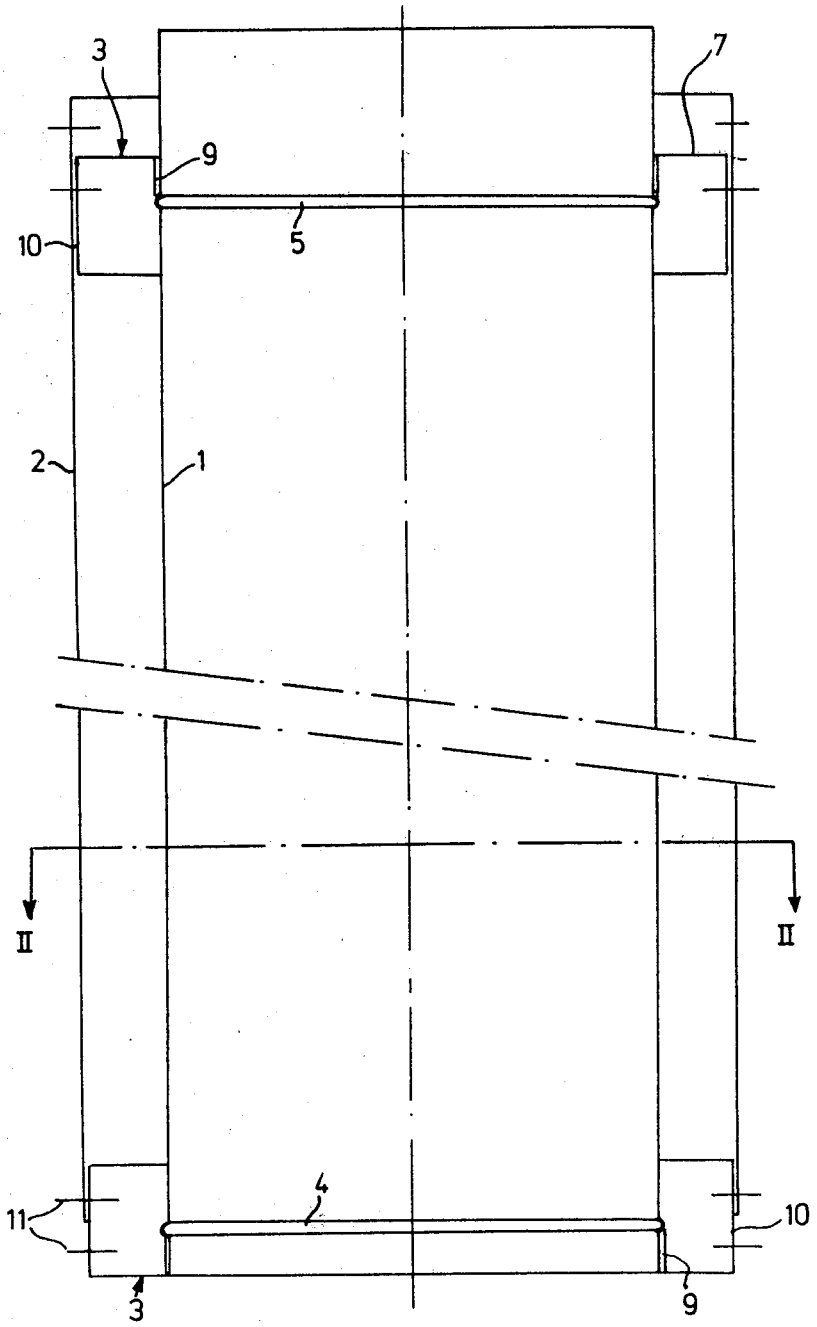
FIG. 1 is a schematic sectional view of a prefabricated chimney-shaft in accordance with the invention.

The prefabricated chimney-shaft shown in FIG. 1, which constitutes a section of the whole chimney to be incorporated in a building or the like, comprises an inner sheath 1 and an outer sheath 2, which are interconnected near their extremities with the aid of tie members 3.

The inner sheath is preferably formed by a conventional cylindrical pipe, which is provided near one end, at a comparatively short distance from said end, with an outwardly embossed bead 4. Near the other end of the pipe 1, but at a slightly larger distance from said end, an outwardly embossed bead 5 is provided in the inner sheath 1.

In the portion of the sheath 1 located, as seen in FIG. 1 above the bead 5 folds extending in the direction of length of the sheath 1 (not shown) are provided for reducing the outer diameter of this inner sheath portion located above the bead 5 so that the outer diameter of this portion above the bead is slightly smaller than the inner diameter of the other end of the sheath 1.

Figure 2:
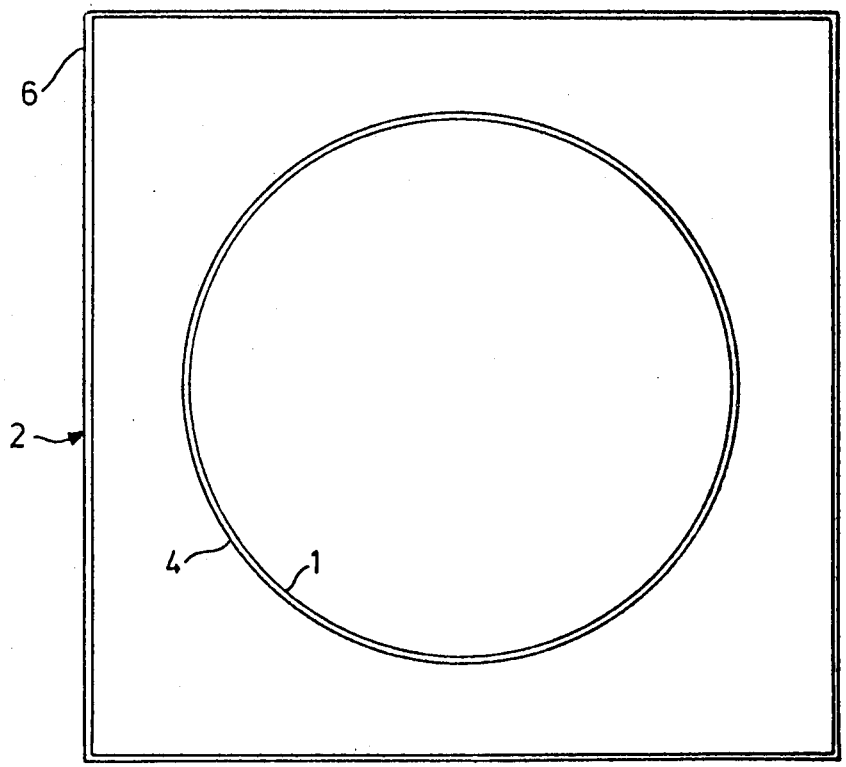
FIG. 2 is a sectional view taken on line II—II in FIG. 1.

From FIG. 2 it will be seen that the outer sheath has a rectangular, preferably square cross-section and is formed by four relatively integral, plate-shaped parts, which are relatively folded over, one of said parts being provided with a flange 6, which is at right angles to said part and which may be fastened, for example, by spot welding to the end of an adjoining part of the sheath 2 in order to form a closed case.

Figure 3:
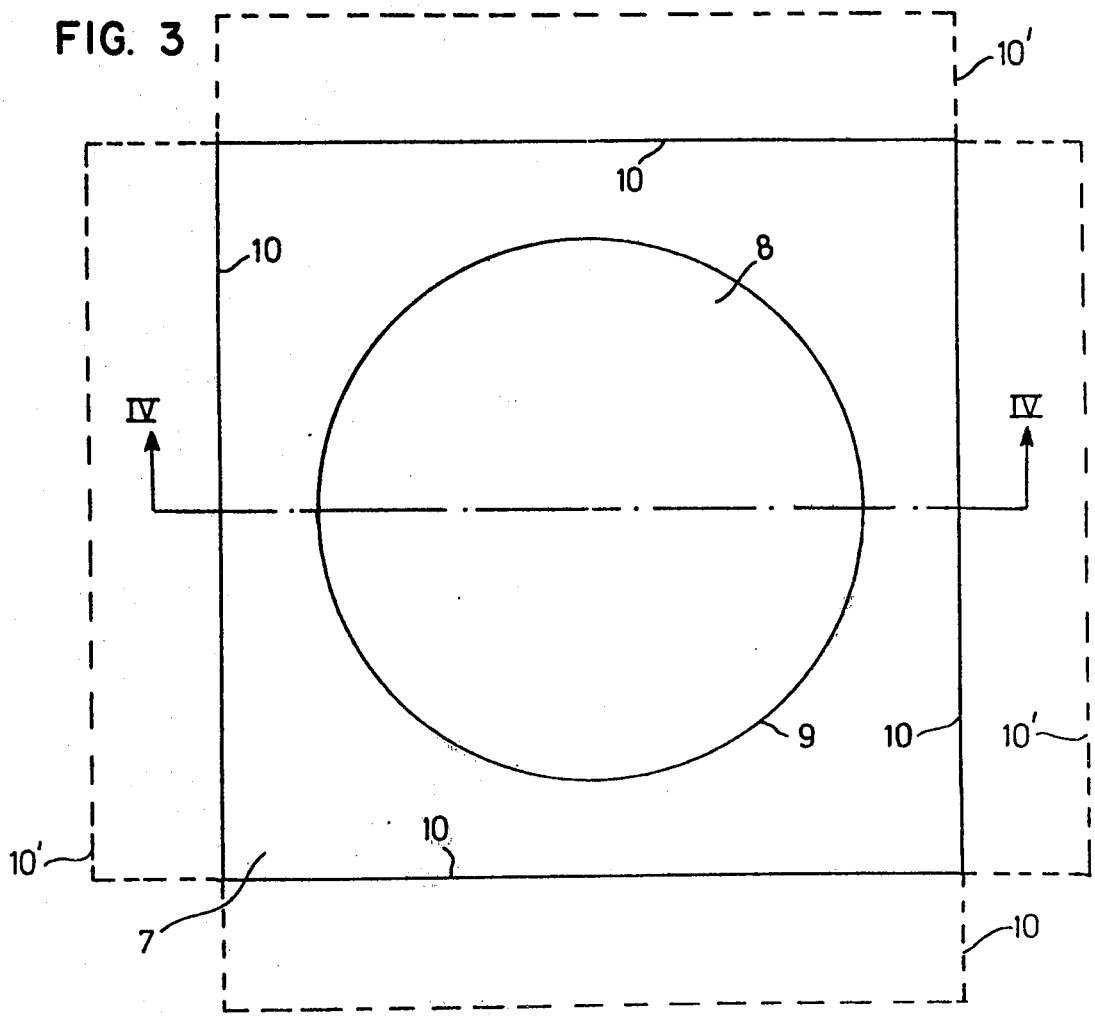
FIG. 3 is an elevational view of a tie member used in the chimney-shaft in accordance with the invention.
Figure 4:
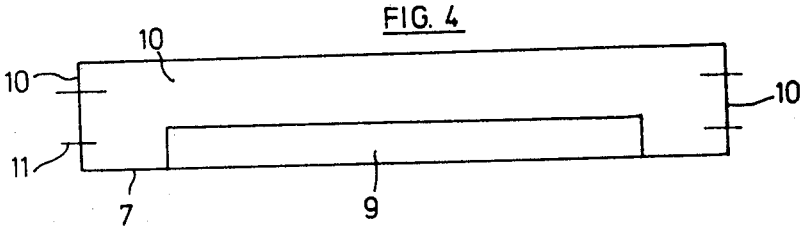
FIG. 4 is a sectional view taken on line IV—IV in FIG. 3.

The tie member 3 is shown in detail in FIGS. 3 and 4. This tie member 3 consisting of a single piece of sheet material has a flat, plate-shaped portion 7, at the centre of which is formed a circular opening 8 bounded by a rim 9 bent over at right angles from the plate-shaped portion.

Along its periphery the plate 7 is provided with four flanges or bent-over rims 10 joining the edges of the plate 7 and being integral with said plate 7, said flanges being formed by folding over parts 10' joining the plate 7 and indicated by broken lines in FIG. 3 through 90°. For folding the rims 10 bores may be made in the rims as is indicated in FIGS. 3 and 4 by the centre lines 11 of such bores. Corresponding bores are made in the sheet material of the outer sheath 2.

From FIG. 1 it will be apparent that at one end of the outer sheath 2, in FIG. 4 at the lower end, the tie member 3 is fastened to the outer sheath 2 so that, for example, with the aid of rivets or Parker screws, the bent-over rims 9 and 10 are directed towards the interior of the inner sheath, whilst the tie member projects below the outer sheath 2 approximately by half its height. Then the inner sheath 1 can be inserted into the sheath 2 so that the bead 4 forming a stop comes into contact with the rim 9, thus preventing the inner sheath 1 from shifting further with respect to the outer sheath 2.

It should be noted that for the sake of clarity some amount of clearance is shown between the rims 9 and 10 of the tie member 3 and the inner side of the outer sheath 2 and the outer side of the inner sheath 1 respectively, but it will be obvious that the embodiment is made so that these parts intimately fit to one another.

Prior to the insertion of the inner sheath 1 into the outer sheath 2 insulating material may be wrapped around the inner sheath 1. Since the inner sheath 1 is located only at four points fairly near the outer sheath and since between said points the clearance between the inner sheath and the outer sheath is larger, the insertion of an inner sheath enveloped in insulating material will not give rise to difficulties. As a matter of course, it is also possible to fill out the space between the inner and outer sheaths after the inner sheath has been inserted into the outer sheath.

From FIG. 1 it will furthermore been seen that after the insertion of the inner sheath into the outer sheath a further tie member 3 is slipped around the inner sheath into the outer sheath until the rim 9 comes into contact with the bead 5, after which the tie member 3 is secured to the outer sheath in this position with the aid of rivets or Parker screws or the like. In this way the inner sheath is guarded against axial displacement by means of the embossed beads 4 and 5 forming stops and co-operating with the rims 9 of the tie members 3 surrounding the inner sheath. The disposition is such that at the top end of the chimney-shaft shown in FIG. 1 the plate-shaped part 7 of the tie member 3 is located in the outer sheath and at a distance from the neighbouring free end of the outer sheath, which distance corresponds approximately to half the height of the rims 10 of the tie member. It will be obvious that thus a chimney-shaft corresponding with that shown in FIG. 1 can be joined to the chimney-shaft shown in FIG. 1 so that the part of the inner sheath 1 located above the bead 5, as seen in FIG. 1, is accommodated in the end of the inner sheath of the other chimney-shaft provided with the bead 4, whilst the part of the tie member 3 located below the outer sheath 2 is received in the space above the tie member 3 on the top side of the pipe as shown in FIG. 1. By inserting subsequently Parker screws or the like into the holes of the outer sheath and the tie members, a firm connection can be established between the successive chimney-shaft portions.

It will be obvious that the various portions of the chimney-shaft can be manufactured in a simple manner, whilst owing to the rectangular shape of the outer sheath a chimney built up from such parts will, in general, no longer need further finishing. The chimney may, if desired, be fastened with the aid of brackets, which are secured to the chimney by means of the screws by which the successive portions of the chimney are interconnected.

Figure 5:
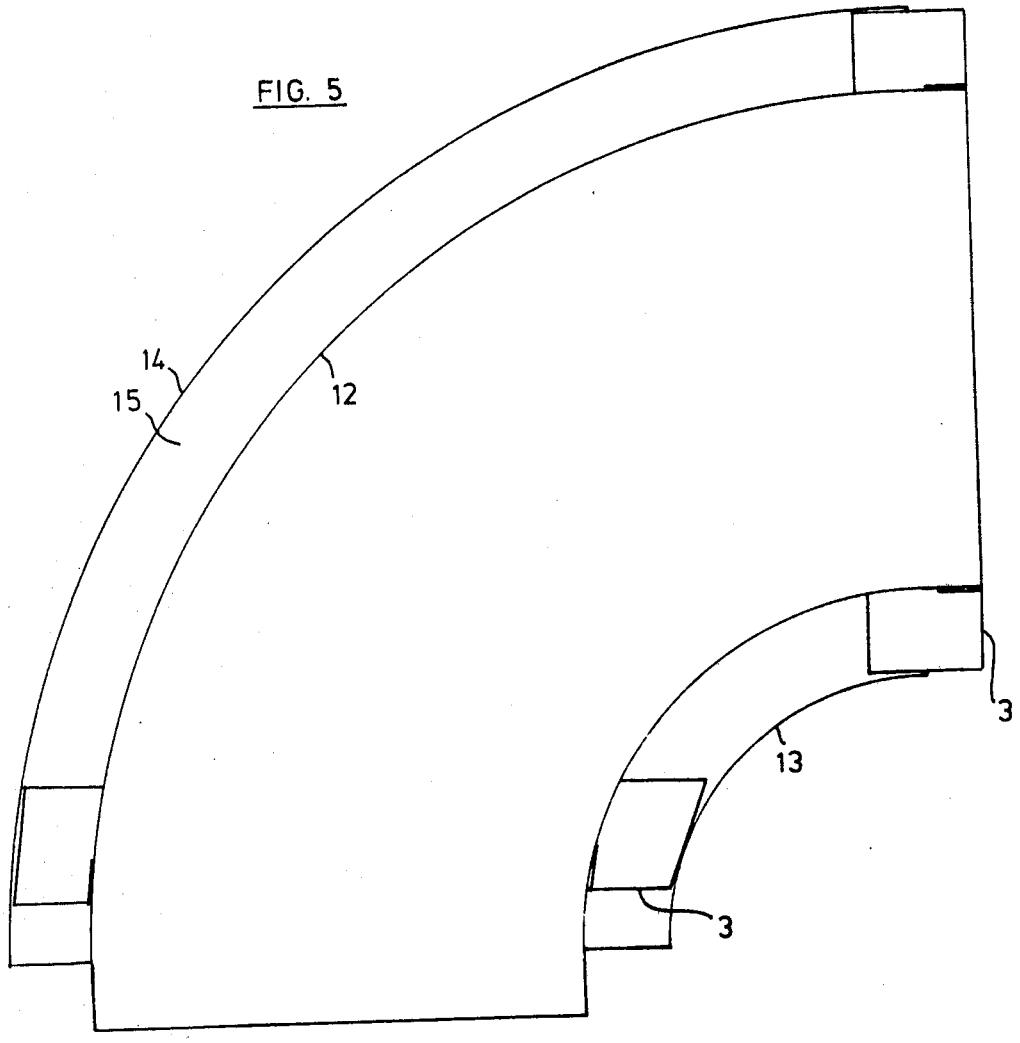
FIG. 5 is a schematic cross-sectional view of a bend.

Even bends for a chimney according to the invention can be made in a simple manner, as will be evident from FIG. 5. In the construction illustrated in FIG. 5 the inner sheath is constituted by a circular pipe 12, which is made in known manner from a straight pipe by making folds (not shown) as commonly used in the known elbows of oven pipes. The outer sheath is made from two plates 13 and 14 curved in the desired manner, which are at right angles to and connected by their edges with side plates 15 cut to the desired shape. Also in this case the inner sheath 12 and the outer sheath of rectangular cross-section formed by the plates 13 to 15 are interconnected by tie members 3, whilst in the same manner as described above one tie member partly projects out of the outer sheath and the other tie member 3 is located inside the inner sheath at a given distance from the end of the outer sheath located near said tie member. It will be obvious that such a bend can be joined without the need for further means to the pipe shown in FIG. 1, whilst as a matter of course the bend may be constructed with any desired angle. The inner sheath of the bend has, of course, a smaller diameter at one end than at the other in the same manner as described above for the straight portion so that the successive parts will join one another in satisfactory sealing relationship against leakage of flue gases.

I claim:

1. A prefabricated chimney-shaft comprising an inner sheath and an outer sheath surrounding said inner sheath, in which the inner sheath and the outer sheath are interconnected near their two ends with the aid of tie-members and at least the outer sheath has a multi-angled cross section, and near each said end of the outer sheath is positioned a tie-member comprising a plate extending substantially perpendicular to the longitudinal axis of the chimney, the shape of said plate being adapted to the inner cross-section of the outer sheath, and at its periphery said plate is provided with first bent-over rims for joining the outer sheath, and the tie-member further has a passage bounded by a second bent-over rim for engaging the inner sheath, such that said first and second bent-over rims of each said tie-member are arranged to face one another, and at one end of the outer sheath both of said rims project a longitudinal distance out of the outer sheath over a portion of their height and near the other end of the outer sheath the tie-member and both of its rims are recessed a longitudinal distance from said other end.

2. A chimney-shaft as claimed in claim 1 wherein the inner sheath is provided with stops co-operating with the tie members and preventing a shift of the inner sheath with respect to the outer sheath in an axial direction.

3. A chimney-shaft as claimed in claim 2 characterized in that the stops are formed by beads outwardly embossed in the inner sheath.

4. A chimney-shaft as claimed in claim 1, 2 or 3 wherein the outer sheath is formed by two relatively parallel circle-segment-shaped plates interconnected by curved plates extending at right angles to said plates.

5. A chimney-shaft as claimed in claim 1 wherein said outer sheath cross section is substantially rectangular.

* * * * *